US011117415B2

(12) United States Patent
Albenge et al.

(10) Patent No.: US 11,117,415 B2
(45) Date of Patent: Sep. 14, 2021

(54) FREE INK WRITING INSTRUMENT WITH MICROFLUIDIC VALVE

(71) Applicant: Societe BIC, Clichy (FR)

(72) Inventors: Olivier Albenge, Mortcerf (FR); Laudine Buge, Villejuif (FR); Christelle Debrauwer, Saint Germain sur Morin (FR); Anne-Lise Damiano, Lagny sur Marne (FR); Claire Evrard, Saint Mande (FR)

(73) Assignee: Societe BIC, Clichy (FR)

( * ) Notice: Subject to any disclaimer, the term of this patent is extended or adjusted under 35 U.S.C. 154(b) by 114 days.

(21) Appl. No.: 16/622,682

(22) PCT Filed: Jun. 14, 2018

(86) PCT No.: PCT/FR2018/051410

§ 371 (c)(1),
(2) Date: Dec. 13, 2019

(87) PCT Pub. No.: WO2018/229443

PCT Pub. Date: Dec. 20, 2018

(65) Prior Publication Data

US 2020/0207144 A1 Jul. 2, 2020

(30) Foreign Application Priority Data

Jun. 15, 2017 (FR) ..... 1755418

(51) Int. Cl.
*B43K 5/18* (2006.01)
*B43K 7/03* (2006.01)

(52) U.S. Cl.
CPC ..... *B43K 5/1827* (2013.01); *B43K 7/03* (2013.01)

(58) Field of Classification Search
CPC . B43K 8/003; B43K 8/03; B43K 8/04; B43K 8/146; B43K 8/165; B01B 2201/054; F16K 99/0015; F16K 99/0057
See application file for complete search history.

(56) References Cited

U.S. PATENT DOCUMENTS 2,314,551 A * 3/1943 Olson ..... B43K 23/12 401/246
5,496,009 A * 3/1996 Farrell ..... F15C 3/04 251/61.1

(Continued)

FOREIGN PATENT DOCUMENTS

DE 3910787 C1 * 9/1990 ..... B43K 5/145
DE 4328312 A1 3/1995

(Continued)

OTHER PUBLICATIONS

International Search Reported issued in PCT/FR2018/051410, dated Oct. 17, 2018 (4 pages) with English translation (3 pages).

*Primary Examiner* — David P Angwin
*Assistant Examiner* — Bradley S Oliver
(74) *Attorney, Agent, or Firm* — Bookoff McAndrews, PLLC

(57) ABSTRACT

A writing instrument including a main body provided with a writing tip. The writing tip being supplied with ink by a free ink-type reservoir equipped with a pressure regulating device for regulating the pressure within the reservoir. The pressure regulating device includes at least one microfluidic valve.

15 Claims, 3 Drawing Sheets

(56) References Cited

U.S. PATENT DOCUMENTS

| | | | | |
|---|---|---|---|---|
| 6,113,296 | A * | 9/2000 | Weiss | B43K 5/1845 401/199 |
| 6,240,962 | B1 * | 6/2001 | Tai | F15C 5/00 137/852 |
| 6,503,016 | B2 * | 1/2003 | Raps | A45D 34/042 401/198 |
| 8,528,591 | B2 * | 9/2013 | Pirk | F16K 99/0001 137/493.8 |
| 9,267,618 | B2 * | 2/2016 | Park | F16K 99/0059 |
| 2004/0120836 | A1 * | 6/2004 | Dai | F04B 43/046 417/413.2 |
| 2009/0154982 | A1 | 6/2009 | Khoshnevis | |
| 2013/0032235 | A1 * | 2/2013 | Johnstone | F04B 43/02 137/833 |

FOREIGN PATENT DOCUMENTS

| | | | |
|---|---|---|---|
| DE | 10212278 | A1 | 10/2003 |
| DE | 10212279 | A1 | 10/2003 |
| EP | 1837200 | A2 | 9/2007 |

* cited by examiner

FREE INK WRITING INSTRUMENT WITH MICROFLUIDIC VALVE

CROSS REFERENCE TO RELATED APPLICATION(S)

This application is a National Stage Application of International Application No. PCT/FR2018/051410, filed on Jun. 14, 2018, now published as WO2018/229443 and which claims priority to French Application No. FR1755418, filed Jun. 15, 2017.

FIELD

The disclosure relates to the field of "free-ink" writing instruments, and more particularly to a pressure regulating device for a free-ink writing instrument.

As a reminder, a "free-ink writing instrument" or a "writing instrument having a free-ink reservoir" is a writing instrument in which the ink is free to flow in the reservoir. In other words, the ink flows instantaneously from one side of the reservoir or the other, for example under the influence of gravity. In particular, the ink will be understood to be capable of moving when the writing instrument is manipulated or when the writing instrument is moved.

PRIOR ART

An ongoing problem with free-ink writing instruments is that of avoiding evaporation of the solvents in the ink while regulating the pressure within the ink reservoir to avoid ink leakage in the region of the tip.

One known solution involves providing a writing instrument of this kind with a baffle, a porous element and/or a fibrous element that is/are connected to a pressure regulating channel.

At the same time, the pressure regulating channel generally opens into the vicinity of the writing tip. Thus, when the tip is protected by a cap that seals a space around the writing tip to avoid evaporation of the solvents in the ink, the baffle/porous element/fibrous element can no longer perform its pressure regulating function. This is particularly problematic when the writing instrument is exposed to an environment that leads to significant changes in pressure between the inside and the outside of the ink reservoir, for example in an airplane or when exposed to direct sunlight in a car.

There is therefore a need for improvement in this respect.

SUMMARY

One embodiment relates to a writing instrument comprising a main body that is provided with a writing tip, the writing tip being supplied with ink by a free-ink reservoir, the reservoir being provided with a pressure regulating device for regulating the pressure within the reservoir, the pressure regulating device comprising at least one microfluidic valve.

Of course, the free-ink reservoir may be formed by the main body of the writing instrument (i.e. the gripping body) or by a cartridge separate from the main body.

In the following and unless specified otherwise, "the valve" will be understood to mean "the at least one valve."

As a reminder, microfluidics is the science and technology of systems that manipulate fluids, at least one of the characteristic dimensions thereof being in the micrometer range. In the size range, certain phenomena that are negligible when larger size ranges are being considered (i.e. larger by a factor of 10 or more) become preponderant, for example capillarity, while other phenomena, such as gravity, become negligible despite being preponderant when larger size ranges are being considered. Microfluidic systems are generally characterized by a small Reynolds number (ratio between the inertial forces and the viscous forces): the viscous forces are dominant. The science of microfluidics includes several facets that are not limited to the flow of fluids. For example, a core microfluidic function is the actuation of the fluid(s) term covering the injection, controlled movement and the various operations performed on the fluid. The functions are implemented by a variety of primary microfluidic components, for example microfluidic valves. By way of example, there are also microfluidic pumps, microfluidic mixers, etc. Currently, microfluidic elements are mainly used in the field of biology/microbiology.

Owing to the microfluidic valve, since gravity phenomena are negligible compared to capillarity phenomena, the pressure within the ink reservoir can be regulated while avoiding ink leakage (as a result of ink flow due to gravity, for example). A surprising observation that microfluidic valves, which are typically implemented in a hydraulic circuit in the field of biology/microbiology, could also be used for gas circuits, and that even with relatively low rates of gas flow (the flow area being in the micrometer range), microfluidic valves allow the pressure between the inside and the outside of the ink reservoir to be adequately regulated. Furthermore, since the microfluidic valve is closed "by default," i.e. as long as the difference in pressure between the outside and the inside of the reservoir does not reach a predetermined threshold, evaporation of the solvents in the ink is avoided while adequately regulating the pressure within the ink reservoir. It will thus be understood that to avoid ink leakage, the microfluidic valve opens when the pressure inside the reservoir exceeds a predetermined threshold in relation to the pressure outside the reservoir to equalize the pressure between the outside and the inside of the reservoir, and otherwise remains closed. In other words, the pressure regulating device according to the present disclosure will be understood to be a passive regulating device (i.e. which does not require external energy input, in particular electrical energy, to function). Furthermore, it will be understood that to regulate the pressure within the reservoir, the microfluidic valve only comprises openings that open into the inside of the reservoir and into the environment outside the reservoir (i.e. the surrounding air), which is separate from the ink supply circuit of the writing tip. In other words, within the meaning of the present disclosure, "outside of the reservoir" will be understood to mean "the environment outside of the reservoir (i.e. the surrounding air), which is separate from the ink circuit supplied by the reservoir." The gas circuit in which the microfluidic valve is arranged between the inside and the outside of the reservoir is separate from the ink-supplying circuit of the writing tip, the circuit being supplied with ink by the reservoir.

In certain embodiments, the microfluidic valve has a predetermined positive-pressure opening threshold for the difference in pressure between the outside and the inside of the reservoir, for example greater than or equal to 25 mbars (twenty-five millibars).

In other words, the microfluidic valve only opens if the positive pressure inside the reservoir in relation to the outside of the reservoir is greater than the predetermined positive-pressure opening threshold for the pressure difference, and remains closed when the positive pressure is less than the predetermined positive-pressure opening threshold for the pressure difference. It is thus ensured that any potential positive pressure inside the reservoir remains at a predetermined level. By selecting a positive-pressure opening threshold for the pressure difference to be greater than or equal to 25 mbars, a maximum acceptable level of positive pressure is ensured to avoid undesired ink leakage, while reducing as much as possible the opening frequency of the microfluidic valve to avoid untimely fatigue of the microfluidic valve and untimely evaporation of the solvents in the ink, evaporation of this kind being detrimental to the quality of the ink over time.

In certain embodiments, the microfluidic valve has a predetermined negative-pressure opening threshold for the difference in pressure between the outside and the inside of the reservoir, for example greater than or equal to 25 mbars (twenty-five millibars).

In other words, the microfluidic valve only opens if the negative pressure inside the reservoir in relation to the outside of the reservoir is less than the predetermined negative-pressure opening threshold for the pressure difference, and remains closed when the negative pressure is greater than the predetermined negative-pressure opening threshold for the pressure difference. It is thus ensured that any potential negative pressure inside the reservoir remains at a predetermined level. By selecting a negative-pressure opening threshold for the pressure difference to be less than or equal to 25 mbars, a maximum acceptable level of negative pressure is ensured to ensure that the tip is adequately supplied with ink by preventing disruption to the flow of ink to the tip, while reducing as much as possible the opening frequency of the microfluidic valve to avoid untimely fatigue of the microfluidic valve.

In certain embodiments, the predetermined positive-pressure opening threshold for the difference in pressure between the outside and the inside of the reservoir and the predetermined negative-pressure opening threshold for the difference in pressure between the outside and the inside of the reservoir have the same value. A selection of this kind has the advantage of facilitating the manufacture of the writing instrument. After all, no particular care need be taken to distinguish the valves when they are mounted, in such a way that manufacture is facilitated and the associated costs are kept down.

In certain embodiments, the microfluidic valve is separated from the inside of the reservoir by an element that is permeable to gases and impermeable to liquids.

In the following, and unless specified otherwise, "permeable element" will be understood to mean an "element that is permeable to gases and impermeable to liquids." The permeable element will be understood to be arranged, based on the fluid circuit, between the enclosure of the ink reservoir and the microfluidic valve.

A permeable element of this kind makes it possible to ensure that only gases flow within the microfluidic valve, but not liquids. The risk of ink leakage via the microfluidic valve is thus reduced.

In certain embodiments, the microfluidic valve comprises a section arranged on the inside of the reservoir, the section comprising a non-wettable coating.

For example, the section is a channel that opens into the enclosure of the ink reservoir, a chamber of the microfluidic valve that is arranged on the reservoir side in relation to the movable element (or flap) of the microfluidic valve (in general, a membrane), or the surface of the movable element arranged on the reservoir enclosure side.

In general, it will be understood that the inside of the reservoir is considered to be in relation to the movable element of the microfluidic valve. In other words, a section of the microfluidic valve arranged on the inside of the reservoir is a section that is arranged, based on the fluid circuit within the microfluidic valve, between the inside of the reservoir and the movable element of the microfluidic valve.

"Non-wettable coating" is understood to mean a coating that cannot be wetted (cf. partial wetting or zero wetting). For example, a hydrophobic or oleophobic coating is a coating that cannot be wetted by an aqueous solution or an oil, respectively.

By providing a non-wettable coating of this kind, it is ensured that the ink does not tend to seep into the microfluidic valve. The risk of ink leakage via the microfluidic valve is thus reduced.

In certain embodiments, the writing instrument comprises a detachable cap configured to protect the writing tip in a protection position, the cap covering a protected portion of the main body in the protection position, the microfluidic valve comprising at least one channel that opens into the outside of the main body, the channel opening being in a portion of the main body that is separate from the protected portion.

In this way, when the writing instrument is provided with the cap, i.e. when the writing tip is protected by the cap, the microfluidic valve is still in fluidic contact with the outside of the reservoir, which is at atmospheric pressure, meaning that the pressure is regulated within the reservoir between the inside and the outside of the reservoir whatever the configuration of the writing instrument (writing tip protected by the cap or not), which improves the robustness of the writing instrument to ink leakage.

As a reminder, in known pressure regulating systems, such as baffles, porous elements and/or fibrous elements, to avoid evaporation of the solvents in the ink the pressure regulating vent is disposed in the vicinity of the writing tip in such a way that the vent is cut off from the outside environment of the pen when the writing tip is protected by the cap. In this way, the pressure can only be regulated if the cap is taken off (i.e. the pressure is not regulated when the writing tip is protected by the cap). Consequently, when there is a significant change in the surrounding pressure, for example during an airplane journey, ink may leak, even in the presence of a baffle.

In certain embodiments, the microfluidic valve comprises three separate chambers, namely an inlet chamber, an outlet chamber and a regulating chamber, the inlet chamber and the outlet chamber being adjacent and separated by a wall, the wall having a projection that extends towards the inside of the inlet chamber.

It will be understood that the inlet chamber is the chamber through which the gas enters when the pressure is regulated, the regulating chamber is the chamber which is always in fluidic communication with the reference environment for pressure regulation, and the outlet chamber is the chamber through which the gas escapes when the pressure is regulated. A further observation was that a projection formed by the separating wall and extending into the inlet chamber may allow for an improvement in the response of the membranes to changes in pressure difference. This allows an improvement in the reliability of the pressure regulation within the ink reservoir.

In certain embodiments, the pressure regulating device comprises only at least one microfluidic valve.

It will thus be understood that the pressure regulating device comprises only one or more microfluidic valves and no other element that allows the pressure to be regulated. This allows the costs of manufacturing the writing instrument to be reduced.

In certain embodiments, the writing instrument comprises a plurality of microfluidic valves while the reservoir extends in an axial direction and a circumferential direction, the microfluidic valves being distributed in the axial direction and/or the circumferential direction of the reservoir.

Distributing the microfluidic valves in this way makes it possible to ensure that under any circumstances, there is a microfluidic valve that is not obstructed by ink. In other words, it is ensured that there is always a microfluidic valve that opens directly into a gaseous portion within the ink reservoir. This improves the pressure regulation within the ink reservoir and the reliability of the regulating device in relation to ink leakage.

In one variant, the microfluidic valves are evenly distributed in the axial direction and/or the circumferential direction of the reservoir. For example, the microfluidic valves are distributed on the wall of the reservoir along a helical curve around the axial direction. For example, there is a microfluidic valve every centimeter and/or every 30° (degree of angle). This again improves the pressure regulation within the ink reservoir and the reliability of the regulating device in relation to ink leakage.

In certain embodiments, the at least one microfluidic valve comprises a bidirectional microfluidic-valve unit.

It will be understood that a bidirectional unit may comprise either two separate unidirectional microfluidic valves of which the fluid flow directions are opposite (i.e. one valve allowing flow from the inside to the outside of the reservoir only, and the other valve allowing flow from the outside to the inside of the reservoir only), a bidirectional valve (i.e. a valve acting as a combination of two separate unidirectional valves of which the permitted fluid flow directions are opposite), or a combination of unidirectional and bidirectional valves.

A bidirectional unit of this kind makes it possible to ensure both a predetermined level of positive pressure and a predetermined level of negative pressure within the reservoir. This makes it possible to improve the reliability of the writing instrument, firstly by preventing the risk of ink leakage and secondly by preventing excessive negative pressure, which would hamper the supply of ink to the writing tip.

In certain embodiments, the pressure regulating device comprises a baffle and/or a porous or fibrous element, the at least one microfluidic valve being unidirectional.

In a configuration of this kind, the microfluidic valve makes it possible to regulate the pressure within the ink reservoir when the baffle and/or a porous or fibrous element is/are inoperative, for example when the writing tip is protected by a cap. In this case, to optimize costs it is not necessary to provide a bidirectional valve, a unidirectional valve being sufficient (for example to avoid only positive pressure within the reservoir).

One embodiment concerns a writing instrument comprising a main body that is provided with a writing tip, and comprising a detachable cap that is configured to protect the writing tip in a protection position, the writing tip being supplied with ink by a free-ink reservoir, the reservoir being provided with a pressure regulating device for regulating the pressure within the reservoir, the pressure regulating device comprising a baffle and/or a porous or fibrous element, the cap being provided with at least one microfluidic valve for regulating the pressure inside the cap in the protection position.

By arranging a microfluidic valve on the cap, it is ensured that the baffle and/or the porous or fibrous element performs its pressure regulating function within the ink reservoir even when the cap is closed, while avoiding evaporation of the solvents in the ink (the microfluidic valve being closed by default).

BRIEF DESCRIPTION OF THE DRAWINGS

The disclosure and its advantages will be better understood upon reading the following detailed description of various embodiments given by way of non-limiting example. The description refers to the accompanying pages of drawings, in which.

DETAILED DESCRIPTION

Figure 1:
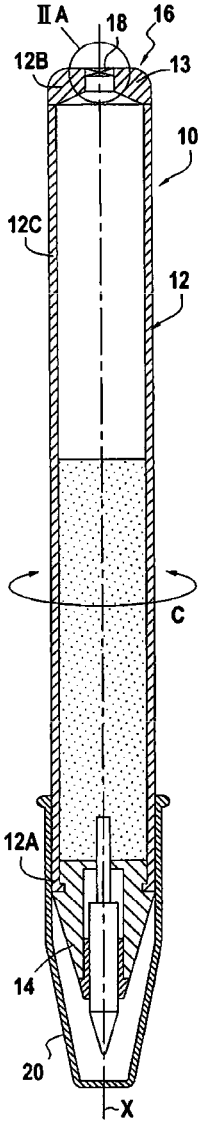
FIG. 1 shows a first embodiment of a writing instrument.

FIG. 1 shows a first embodiment of a writing instrument 10. The writing instrument 10 comprises a main body 12 provided with a writing tip 14. In this embodiment, the main body 12 has an inner cavity and forms a free-ink reservoir 12 in which the ink 13 is free to move. Although the main body and the reservoir are formed by the same part in this embodiment, the main body and the reservoir may be formed by two separate parts in a variant.

The reservoir 12 is provided with a pressure regulating device 16 for regulating the pressure within the reservoir 12. In this embodiment, the pressure regulating device 16 comprises a single bidirectional microfluidic-valve unit 18.

It is noted that the reservoir 12 extends in an axial direction X and a circumferential direction C. The writing tip 14 is arranged at a first end 12A in the axial direction X of the reservoir 12. In this embodiment, the bidirectional microfluidic-valve unit 18 is arranged at the second end of the reservoir 12, opposite the first end in the axial direction. The second end 12B is formed by a stopper 13 that is sealingly fastened, by welding in this embodiment, to the tubular portion 12C of the reservoir 12. A configuration of this kind makes it possible to reduce manufacturing costs, only the cap 13 being provided with a bidirectional microfluidic-valve unit 18.

The writing instrument 10 also comprises a detachable cap 20, which is shown in a protection position of the tip 14 in FIG. 1. In the position, the cap 20 covers a portion of the main body 12, the portion forming a "protected" portion. The below-described channels of the bidirectional microfluidic-valve unit 18, which open into the outside of the reservoir 12, open thereinto in a portion separate from the portion protected by the cap 20.

Figure 2A:
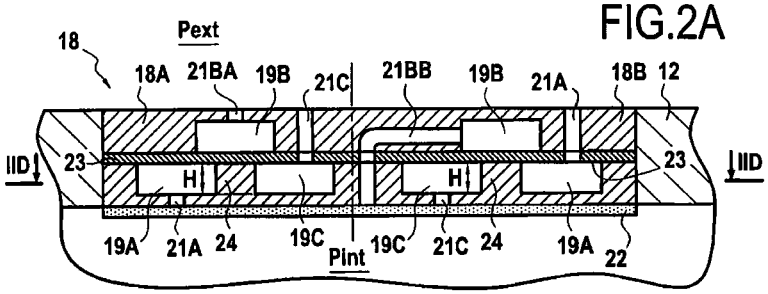
FIG. 2A shows a bidirectional microfluidic-valve unit according to the magnification IIA in FIG. 1, FIGS. 2B and 2C show two separate states of the bidirectional microfluidic-valve unit.
Figure 2B:
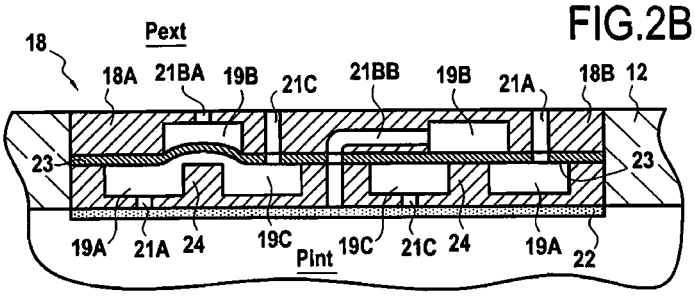
FIG. 2D is a sectional view along plane IID in FIG. 2A.
Figure 2C:
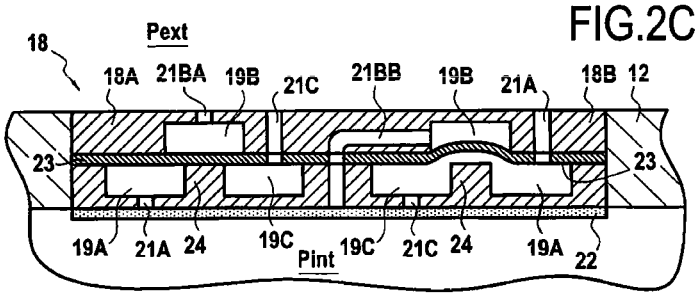

In general, it is noted that the bidirectional microfluidic-valve units 18 are shown symbolically in FIGS. 1, 3, 4 and 5, while the bidirectional microfluidic-valve units 18 are shown as schematic diagrams in FIGS. 2A, 2B and 2C.

More specifically, FIGS. 2A, 2B and 2B show a bidirectional valve comprising two different entities 18A and 18B. In general, if the valve comprises only a plurality of similar entities, the valve is to be unidirectional. If the valve comprises two different types of entities, as shown in FIGS. 2A, 2B and 2C, the valve is to be bidirectional. A bidirectional microfluidic-valve unit comprises one or more bidirectional valves (for example, the valve shown in FIGS. 2A, 2B and 2C), two unidirectional valves of which the possible fluid flow directions are opposite, or a combination of bidirectional valves and unidirectional valves.

The bidirectional microfluidic-valve unit 18 will now be described in more detail with reference to FIGS. 2A, 2B and 2C.

It is noted that in this embodiment, the entities 18A and 18B have substantially the same structure having three chambers 19A, 19B and 19C, a membrane 23 fluidically separating the chambers by default (position shown in FIG. 2A), the chambers each being connected to a channel. In each entity, the chamber 19A forms an inlet chamber 19A, through which the gas enters in the event of pressure regulation via a channel 21A. In the entity 18A, the channel 21A opens towards the inside of the reservoir, while the channel 21A opens towards the outside of the reservoir in the entity 18B. The chamber 19B forms a regulating chamber 19B in fluidic communication with the outside through a channel 21BA, which is a reference environment for the regulation of the pressure inside the reservoir. The chamber 19C forms an outlet chamber 19C, through which the gas escapes in the event of pressure regulation via a channel 21C. In the entity 18A, the channel 21C opens towards the outside of the reservoir, while the channel 21C opens towards the inside of the reservoir in the entity 18B.

In this embodiment, in each entity 18A and 18B, the inlet and outlet chambers 19A and 19C are adjacent and separated by a wall 24, while the chamber 19B faces the chambers 19A and 19B and opens into the chambers 19A and 19B. To fluidically separate the chambers, the membrane 23 is arranged between the chambers 19A and 19C and the chamber 19B. The membrane 23 abuttingly interacts with the wall 24.

Figure 2D:
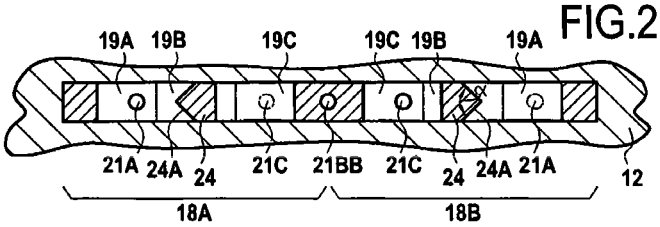

FIG. 2D shows the shape of the wall 24 in a transverse sectional view in parallel with the membrane. In each entity 18A and 18B, the wall 24 has a projection 24A extending towards the inside of the inlet chamber 19A. In this embodiment, the projection has the shape of a projecting ridge, the angle $\alpha$ of the ridge being between 45° and 120°, for example. In this embodiment, the projection 24A extends over the entire height H of the wall 24 (see FIG. 2A). In this embodiment, the sides of the walls 24 on the outlet chamber 19C side do not have a projection, but could, according to a variant, also have a projection that is similar or not similar to the projection 24A.

An element 22 that is permeable to gases and impermeable to liquids is arranged on the bidirectional microfluidic-valve unit 18, on the inside of the reservoir 12, and separates the unit from the inside of the reservoir. Furthermore, in this embodiment, the walls of the channels 21A and 21BB that open into the inside of the reservoir 12 comprise a non-wettable coating (not shown).

The entity 18A makes it possible to avoid positive pressure within the reservoir 12 and places the inside and the outside of the reservoir in fluidic communication if the difference between the pressure Pint inside the reservoir 12 and the pressure Pext outside the reservoir 12 exceeds a first predetermined threshold value $\Delta P1$ (i.e. a predetermined positive-pressure opening threshold for the difference in pressure between the outside and the inside of the reservoir). The membrane 23 of the entity 18A will thus be understood to be configured to move so as to place the inlet chamber 19A and the outlet chamber 19C in fluidic communication if $Pint-Pext>\Delta P1$, as shown in FIG. 2B. In this embodiment, $\Delta P1=25$ mbars. Of course, in general, $\Delta P1$ is a positive or zero value.

The entity 18B makes it possible to avoid excessive negative pressure within the reservoir 12 and places the inside and the outside of the reservoir 12 in fluidic communication if the difference between the pressure Pext outside the reservoir 12 and the pressure Pint inside the reservoir 12 falls below a second predetermined threshold value $\Delta P2$ (i.e. a predetermined negative-pressure opening threshold for the difference in pressure between the outside and the inside of the reservoir). The membrane 23 of the entity 18B will thus be understood to be configured to move so as to place the chamber 19A and the chamber 19C in fluidic communication if $Pext-Pint>\Delta P2$, as shown in FIG. 2C. In this embodiment, $\Delta P2=25$ mbars. Of course, in general, $\Delta P2$ is a positive or zero value. In this embodiment, $\Delta P1=\Delta P2$, but the threshold values may of course be different.

Figure 3:
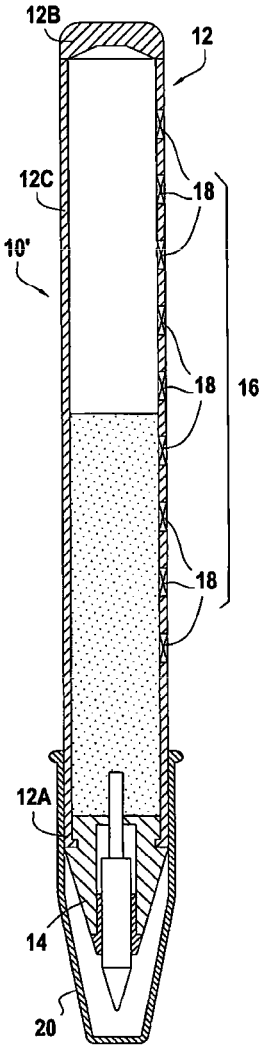
FIG. 3 shows a second embodiment of the writing instrument.
Figure 4:
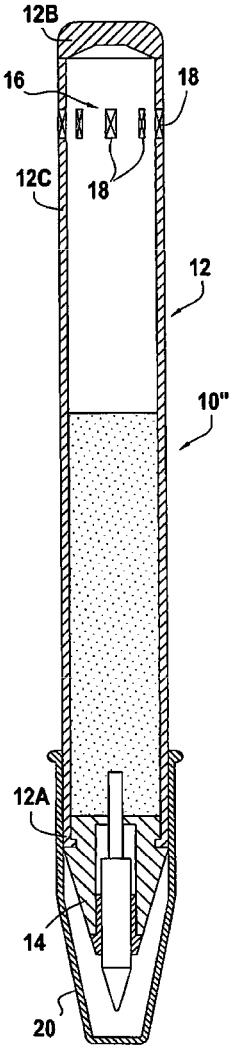
FIG. 4 shows a third embodiment of the writing instrument.
Figure 5:
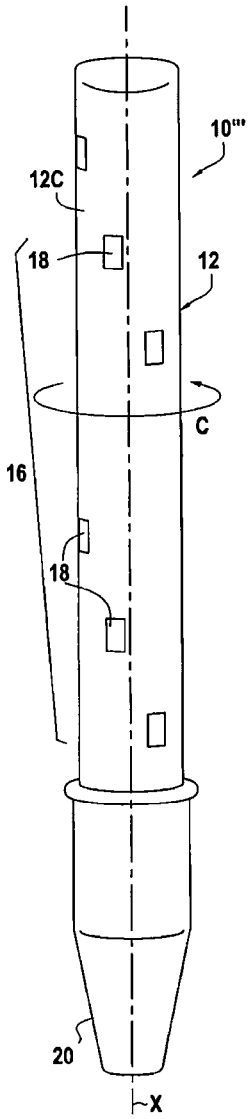
FIG. 5 shows a fourth embodiment of the writing instrument.

FIGS. 3, 4 and 5 are other embodiments of the writing instrument, which differ from the writing instrument 10 in FIG. 1 merely in the number and the arrangement of the bidirectional microfluidic-valve units.

The second embodiment of the writing instrument 10' in FIG. 3 comprises a plurality of bidirectional microfluidic-valve units 18 evenly distributed in the axial direction X of the reservoir 12. For example, each bidirectional microfluidic-valve unit 18 is spaced apart from the adjacent bidirectional microfluidic-valve units 18 by 1 cm (one centimeter) in the axial direction X.

The third embodiment of the writing instrument 10" in FIG. 4 comprises a plurality of bidirectional microfluidic-valve units 18 evenly distributed in the circumferential direction C of the reservoir 12. For example, each bidirectional microfluidic-valve unit 18 is spaced apart from the adjacent bidirectional microfluidic-valve units 18 by 36° in the circumferential direction C, around the axis X of the reservoir 12.

The fourth embodiment of the writing instrument 10''' in FIG. 5 comprises a plurality of bidirectional microfluidic-valve units 18 evenly distributed in the circumferential direction C and in the axial direction X of the reservoir 12. In this embodiment, the bidirectional microfluidic-valve units 18 are distributed in a helical coil around the axis X of the reservoir 12. For example, each bidirectional microfluidic-valve unit 18 is spaced apart from the adjacent bidirectional microfluidic-valve units 18 by 36° in the circumferential direction C, around the axis X of the reservoir 12, and by 1 cm in the axial direction X.

Figure 6:
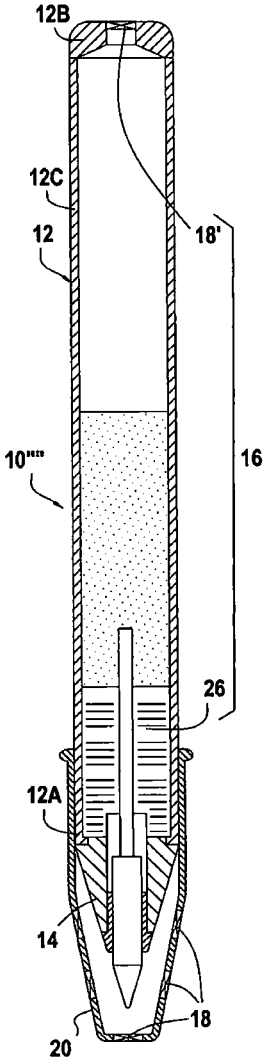
FIG. 6 shows a fifth embodiment of the writing instrument.

FIG. 6 shows a fifth embodiment of the writing instrument 10"" in which, in comparison with the writing instrument 10 in FIG. 1, the pressure regulating device 16 of the reservoir 12 comprises a baffle 26 and a unidirectional microfluidic valve 18'. For example, the microfluidic valve 18' makes it possible to avoid positive pressure inside the reservoir 12. For example, the microfluidic valve 18' only comprises entities of the type 18A in FIG. 2A. In other words, in this embodiment, the microfluidic valve 18' is a "positive pressure" valve. This makes it possible to avoid ink leakage in the event of positive pressure inside the reservoir in relation to the outside of the reservoir, even if the cap 20 is closed. In a variant, the regulating device 16 comprises, in addition to or in place of the baffle 26, a porous or fibrous element (not shown). Of course, the unidirectional microfluidic valve 18' could make it possible to avoid excessive negative pressure inside the reservoir 12 and only comprise entities of the type 18B in FIG. 2A. The microfluidic valve 18' would thus be to be a "negative pressure" valve. At the same time, a configuration of this kind only makes it possible to avoid excessive negative pressure within the reservoir 12, which hampers only the supply of ink to the writing tip, which is not critical since the cap is closed (and thus the user is not using the writing instrument), but not to avoid ink leakage in the event of positive pressure inside the reservoir in relation to the outside of the reservoir when the cap 20 is closed.

It will thus be understood that the pressure regulating device 16 of the reservoir 12 in the first, second, third and fourth embodiments in FIGS. 1, 3, 4 and 5 comprises only one microfluidic valve, while the pressure regulating device 16 of the reservoir 12 in the fifth embodiment in FIG. 6 comprises a combination of at least one microfluidic valve and another separate device, namely a baffle, a fibrous element and/or a porous element.

Figure 7:
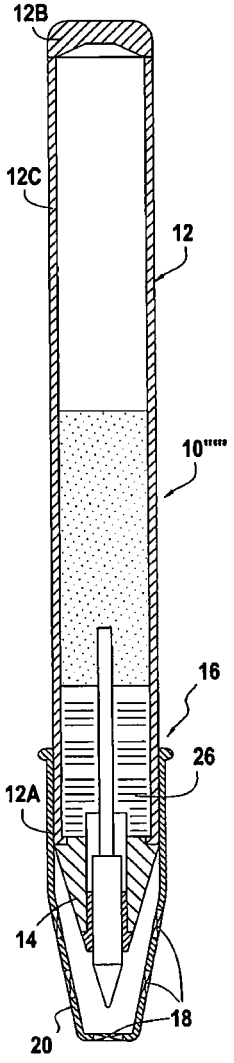
FIG. 7 shows a sixth embodiment of the writing instrument.

FIG. 7 shows a sixth embodiment of the writing instrument 10'''' in which, in comparison with the writing instrument 10 in FIG. 1, the pressure regulating device 16 of the reservoir 12 comprises a baffle 26 but not a microfluidic valve. The cap 20 is provided with a microfluidic valve, in this embodiment a bidirectional microfluidic-valve unit 18 for regulating the pressure between the inside and the outside of the cap 20 when the cap is protecting the writing tip 14 (position shown in FIG. 7). In this way, owing to the bidirectional microfluidic-valve unit 18 of the cap 20, the baffle 26 can regulate the pressure within the reservoir 12 even when the cap 20 is protecting the writing tip 14. Of course, in a variant, the regulating device 16 of the reservoir 12 comprises, in addition to or in place of the baffle 26, a porous or fibrous element (not shown).

Although the present disclosure has been described with reference to specific embodiments, it is evident that it is possible to make modifications and changes to the embodiments without departing from the general scope of the disclosure as defined by the claims. In particular, individual features of the various embodiments illustrated/shown may be combined in additional embodiments. Consequently, the description and drawings should be considered to be illustrative rather than limiting.

The invention claimed is:

1. A writing instrument comprising: a main body provided with a writing tip, the writing tip being supplied with ink by a free-ink reservoir, the free-ink reservoir being provided with a pressure regulating device for regulating the pressure within the free-ink reservoir, the pressure regulating device including at least one microfluidic valve arranged in a gas circuit disposed between an inside and an outside of the free-ink reservoir, wherein the microfluidic valve includes an inlet chamber, an outlet chamber and a regulating chamber, the inlet chamber and the outlet chamber being adjacent and separated by a wall, the wall having a projection that extends towards an inside of the inlet chamber.

2. The writing instrument according to claim 1, wherein the microfluidic valve is separated from the inside of the reservoir by an element that is permeable to gases and impermeable to liquids.

3. The writing instrument according to claim 1, wherein the microfluidic valve includes a section arranged on the inside of the reservoir, the section including a non-wettable coating.

4. The writing instrument according to claim 1, further including a detachable cap configured to cover and protect the writing tip in a protection position, the cap covering a protected portion of the main body in the protection position, the microfluidic valve including at least one channel that opens into the outside of the main body, the channel opening being in a portion of the main body that is separate from the protected portion.

5. The writing instrument according to claim 1, wherein the at least one microfluidic valve includes only one microfluidic valve.

6. The writing instrument according to claim 5, wherein the at least one microfluidic valve includes a bidirectional microfluidic-valve unit.

7. The writing instrument according to claim 1, wherein the at least one microfluidic valve includes a plurality of microfluidic valves, the reservoir extending in an axial direction and a circumferential direction, the microfluidic valves being distributed in the axial direction and/or the circumferential direction of the reservoir.

8. The writing instrument according to claim 1, wherein the pressure regulating device includes a baffle and/or a porous or fibrous element, the at least one microfluidic valve being unidirectional.

9. A writing instrument comprising: a main body including with a writing tip and a detachable cap configured to protect the writing tip in a protection position, the writing tip being supplied with ink by a free-ink reservoir, the reservoir being provided with a pressure regulating device for regulating a pressure within the reservoir, the pressure regulating device including a baffle and/or a porous or fibrous element, the cap being provided with at least one microfluidic valve for regulating a pressure inside the cap in the protection position, wherein the microfluidic valve includes an inlet chamber, an outlet chamber and a regulating chamber, the inlet chamber and the outlet chamber being adjacent and separated by a wall, the wall having a projection that extends towards an inside of the inlet chamber.

10. The writing instrument according to claim 9, wherein the microfluidic valve is separated from the inside of the reservoir by an element that is permeable to gases and impermeable to liquids.

11. The writing instrument according to claim 9, wherein the microfluidic valve includes a section arranged on the inside of the reservoir, the section including a non-wettable coating.

12. The writing instrument according to claim 9, further including a detachable cap configured to cover and protect the writing tip in a protection position, the cap covering a protected portion of the main body in the protection position, the microfluidic valve including at least one channel that opens into the outside of the main body, the channel opening being in a portion of the main body that is separate from the protected portion.

13. The writing instrument according to claim 9, wherein the at least one microfluidic valve includes only one microfluidic valve.

14. The writing instrument according to claim 13, wherein the at least one microfluidic valve includes a bidirectional microfluidic-valve unit.

15. The writing instrument according to claim 9, wherein the at least one microfluidic valve includes a plurality of microfluidic valves, the reservoir extending in an axial direction and a circumferential direction, the microfluidic valves being distributed in the axial direction and/or the circumferential direction of the reservoir.

* * * * *